US010926936B2

(12) United States Patent
Kim

(10) Patent No.: US 10,926,936 B2
(45) Date of Patent: Feb. 23, 2021

(54) VACUUM PACKAGING DEVICE

(71) Applicant: ROLLPACK. CO., LTD., Gyeonggi-do (KR)

(72) Inventor: Kum-Ja Kim, Gyeonggi-do (KR)

(73) Assignee: ROLLPACK. CO., LTD., Gyeonggi-do (KR)

( * ) Notice: Subject to any disclaimer, the term of this patent is extended or adjusted under 35 U.S.C. 154(b) by 267 days.

(21) Appl. No.: 15/770,799

(22) PCT Filed: Oct. 26, 2016

(86) PCT No.: PCT/KR2016/012047
§ 371 (c)(1),
(2) Date: Apr. 25, 2018

(87) PCT Pub. No.: WO2017/073998
PCT Pub. Date: May 4, 2017

(65) Prior Publication Data

US 2018/0319565 A1 Nov. 8, 2018

(30) Foreign Application Priority Data

Oct. 26, 2015 (KR) ..... 10-2015-0148765

(51) Int. Cl.
*B65B 61/18* (2006.01)
*B65D 81/20* (2006.01)
(Continued)

(52) U.S. Cl.
CPC ..... *B65D 81/2038* (2013.01); *B65B 31/02* (2013.01); *B65B 31/024* (2013.01);
(Continued)

(58) Field of Classification Search
CPC ... B65B 31/024; B65B 31/043; B65B 61/005; B65B 61/06; B65B 61/10; B65B 61/18; B26D 83/0841; B26D 1/045; B26D 1/0006; B65H 2701/1752; B65H 35/002; B65D 83/0882
USPC ..... 53/12, 133.1, 133.3, 133.8, 434, 512; 83/100, 175, 649, 614, 648; 225/39, 48, 225/50, 43, 46, 47, 51, 52, 56
See application file for complete search history.

(56) References Cited

U.S. PATENT DOCUMENTS 4,745,730 A * 5/1988 Bartle, Sr. ..... B65B 31/06 141/65
6,256,968 B1 7/2001 Kristen
(Continued)

FOREIGN PATENT DOCUMENTS

CN 200957889 10/2007
JP 2005343553 12/2005
(Continued)

OTHER PUBLICATIONS

International Search Report for PCT/KR2016/012047 dated Jan. 31, 2017, 4 pages.

*Primary Examiner* — Hemant Desai
*Assistant Examiner* — Christopher Robin Kim
(74) *Attorney, Agent, or Firm* — Dority & Manning, P.A.

(57) ABSTRACT

A vacuum packaging device according to the present invention comprises: a vacuum packaging unit for vacuum-packaging a packaging sheet; and a cutting unit provided on the vacuum packaging unit so as to form a notch for tearing on the packaging sheet.

6 Claims, 11 Drawing Sheets

(51) Int. Cl.

| | |
|---|---|
| ***B65B 31/02*** | (2006.01) |
| *B65B 9/20* | (2012.01) |
| *B65B 25/00* | (2006.01) |

(52) U.S. Cl.
CPC ..... *B65B 61/18* (2013.01); *B65B 9/2056* (2013.01); *B65B 25/001* (2013.01)

(56) References Cited

U.S. PATENT DOCUMENTS

| | | | | |
|---|---|---|---|---|
| 2003/0159405 | A1* | 8/2003 | Knowlton | B29C 66/8221 53/434 |
| 2005/0022480 | A1* | 2/2005 | Brakes | B65B 31/046 53/512 |
| 2005/0050860 | A1* | 3/2005 | Sung | B65B 31/046 53/512 |
| 2006/0254219 | A1* | 11/2006 | Alipour | B29C 66/221 53/434 |
| 2016/0297597 | A1 | 10/2016 | Lee | |

FOREIGN PATENT DOCUMENTS

| | | |
|---|---|---|
| KR | 20080113788 | 12/2008 |
| KR | 20090027309 | 3/2009 |
| KR | 20090036812 | 4/2009 |
| KR | 20110042703 | 4/2011 |
| KR | 1488435 | 2/2015 |
| KR | 20150043808 | 4/2015 |
| KR | 20150068658 | 6/2015 |
| WO | WO2013012158 | 1/2013 |
| WO | WO2015135563 | 9/2015 |

* cited by examiner

[FIG. 1]
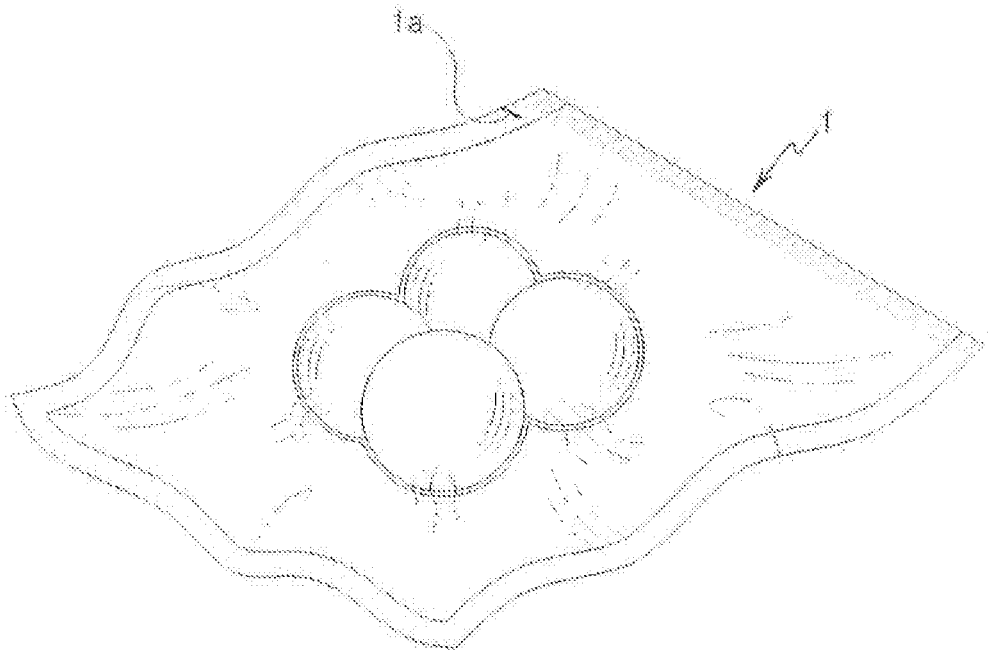

[FIG. 2]
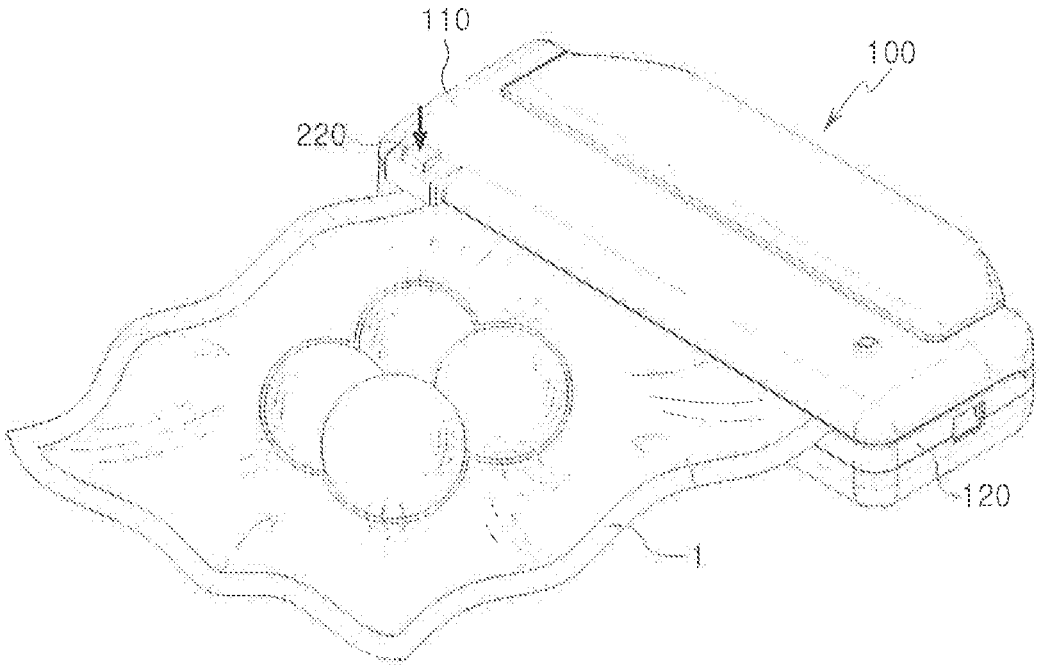

[FIG. 3]
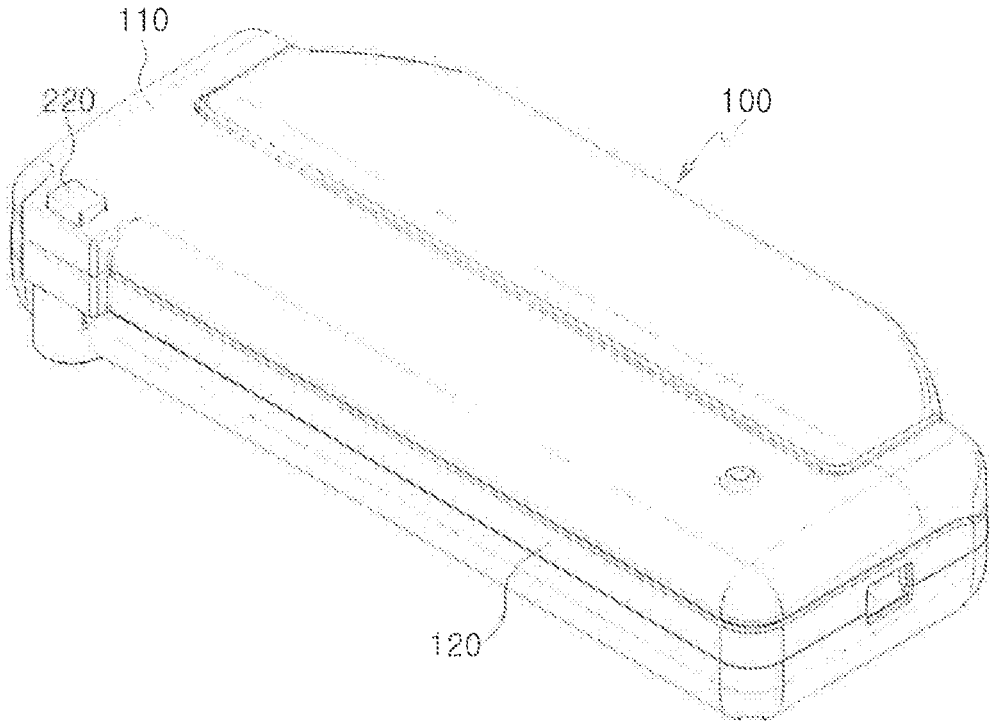

[FIG. 4]
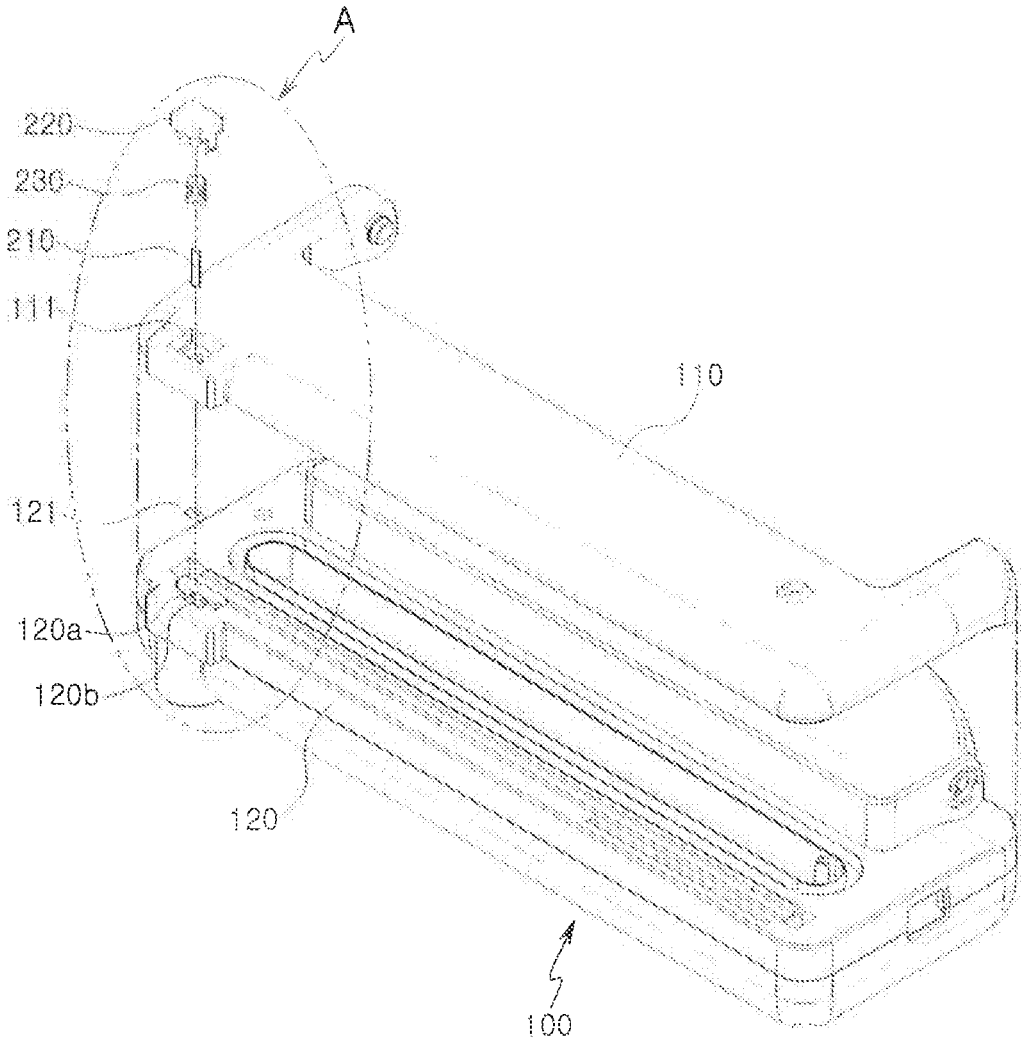

[FIG. 5]
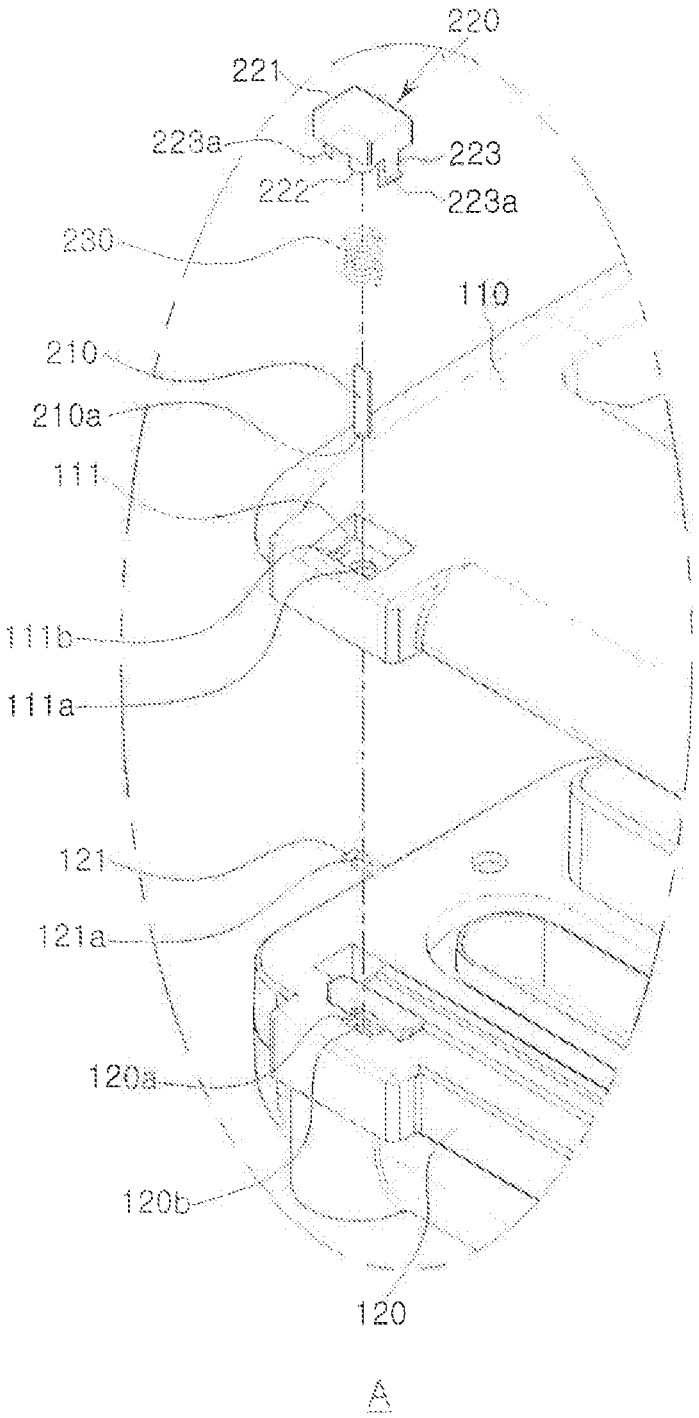

[FIG. 6]
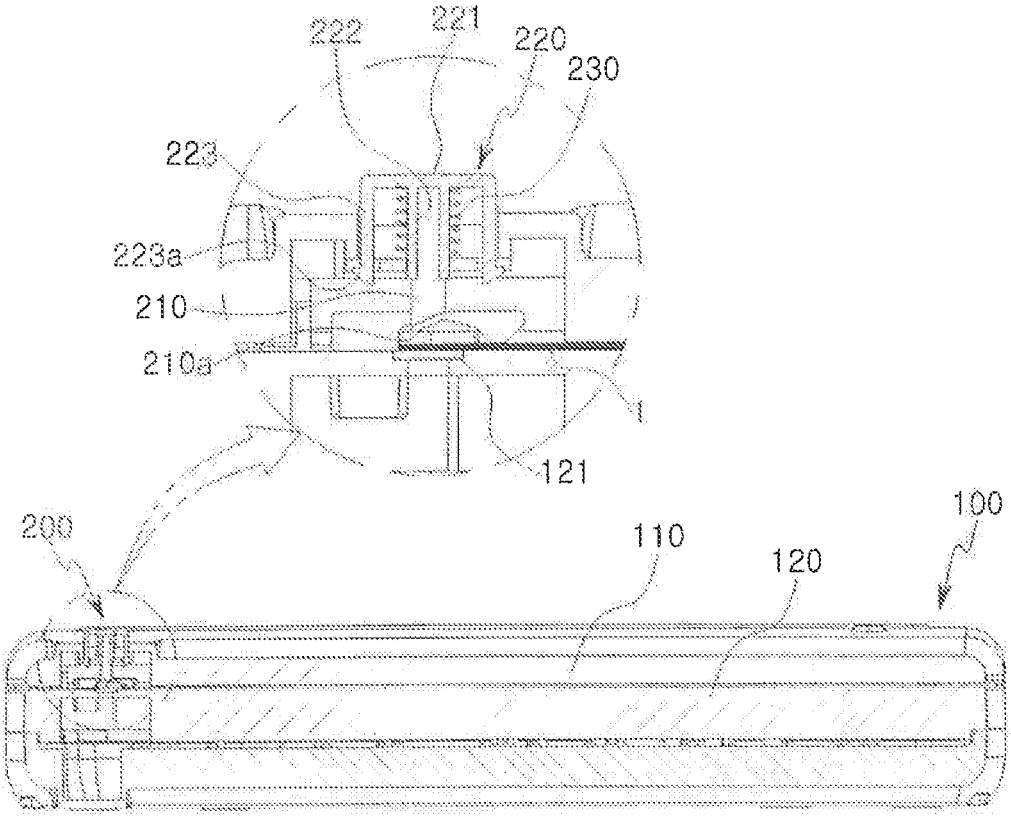

[FIG. 7]
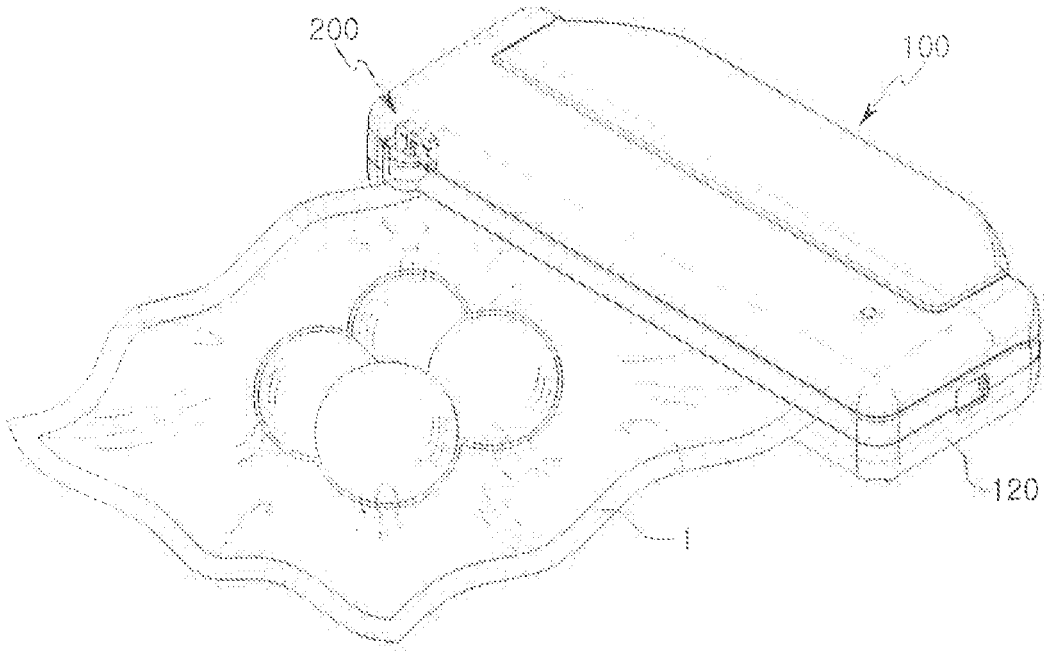

[FIG. 8]
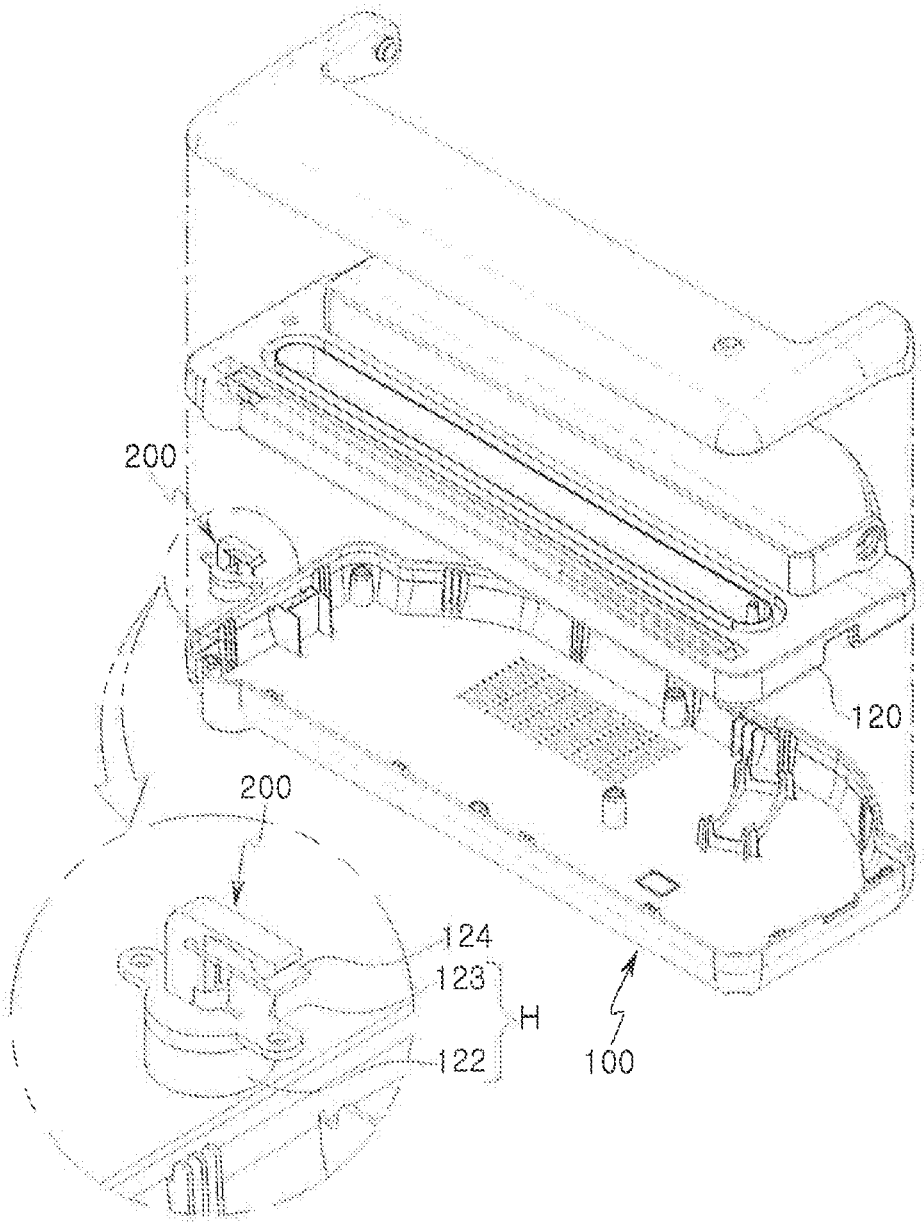

[FIG. 9]
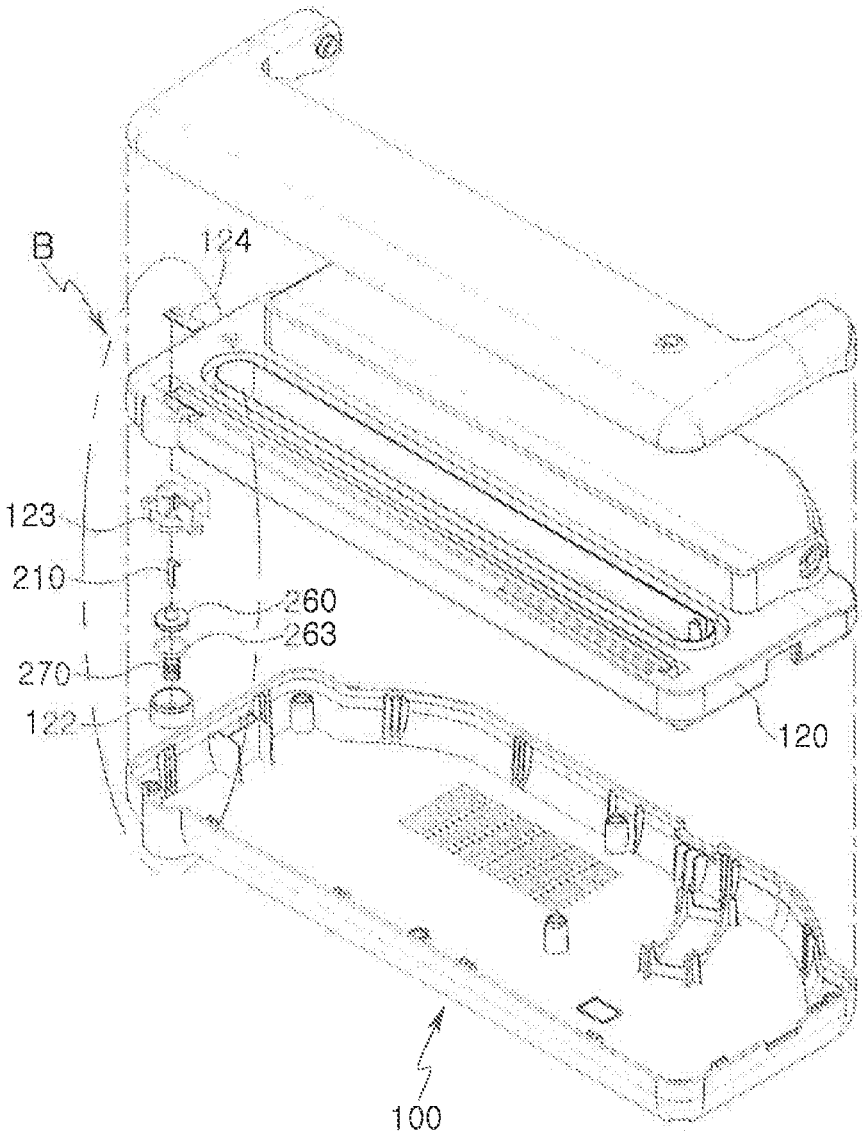

[FIG. 10]
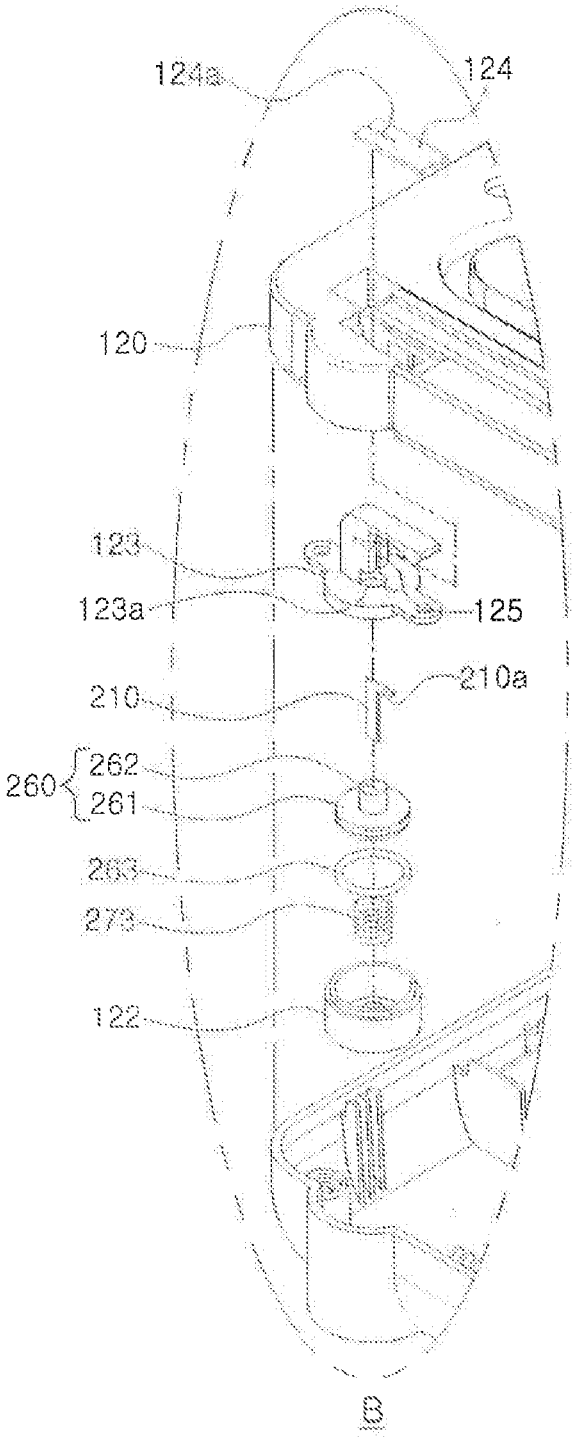

[FIG. 11]
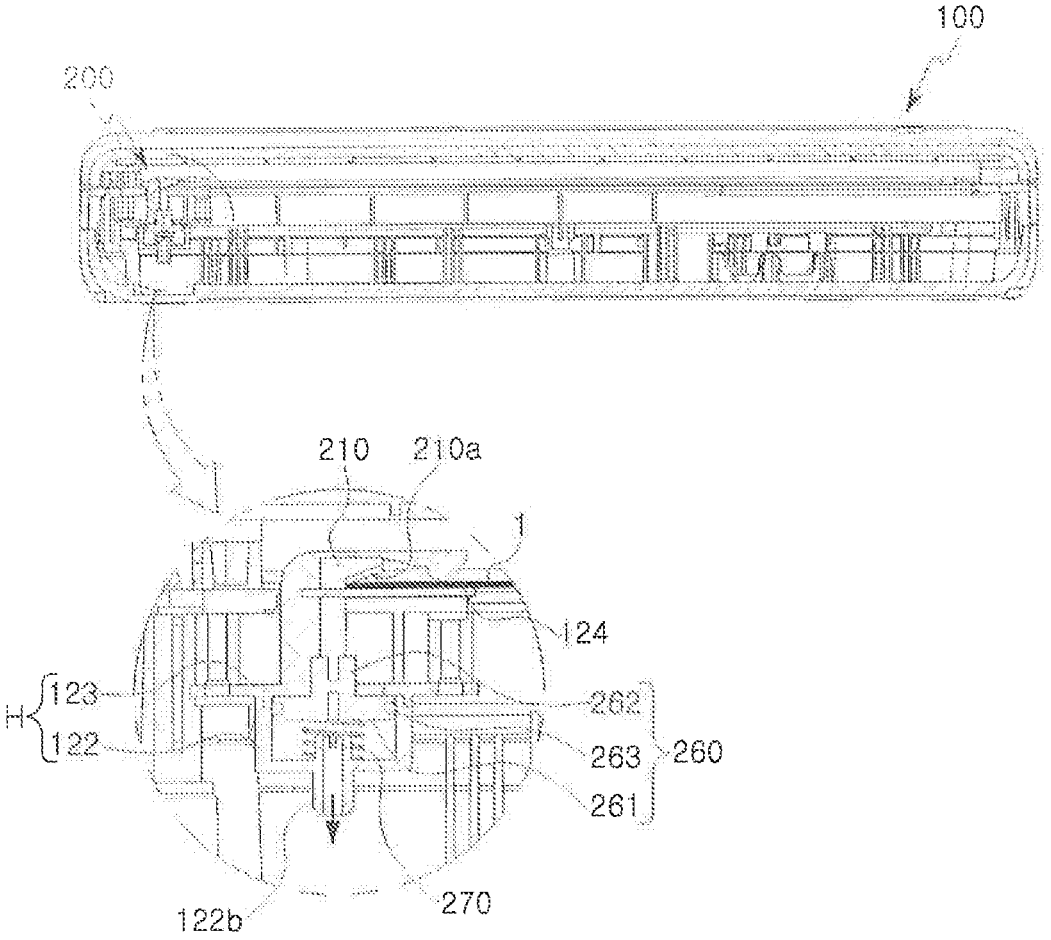

VACUUM PACKAGING DEVICE

TECHNICAL FIELD

The present invention relates to a vacuum packaging device evacuating and sealing a packaging sheet at the same time.

BACKGROUND ART

In order to prevent oxidation and deterioration of food ingredients (or cooked food) for storage over a long period of time, vacuum packaging devices which serve to store food ingredients in a packaging sheet by evacuating air from the packaging sheet and sealing the evacuated packaging sheet have been developed and used.

For example, a vacuum packaging device disclosed in Korean Patent Application No. 10-2013-0124623, is configured to vacuum-package a packaging sheet. However, there is inconvenience in that an additional cutting tool, such as scissors, is required to be used to open the vacuum-packaged packaging sheet.

Further, when such a cutting tool is absent, the packaging sheet should be torn by hand. It is difficult to tear the packaging sheet by hand, and even if the packaging sheet is torn, internal food ingredients may fall on unexpected places during the tearing process, thereby being easily contaminated.

DISCLOSURE

Technical Problem

Aspects of the present disclosure are to address the above mentioned problems, and to provide a vacuum packaging device that allows a sealed packaging sheet to be simply and easily opened.

Technical Solution

According to an aspect of the present disclosure, a vacuum packaging device includes a vacuum packaging unit configured to vacuum-package a packaging sheet, and a cutting unit formed in the vacuum packaging unit to form a tearing notch on the packaging sheet.

Here, the cutting unit may include a cutting member configured to cut the packaging sheet to form the tearing notch, and a driving part installed in the vacuum packaging unit to be connected to the cutting member and move the cutting member to cut the packaging sheet.

More specifically, the vacuum packaging unit may include an externally exposed first supporting groove, the driving part may include a pressing member with the cutting member mounted therein and installed in the first supporting groove to reciprocate to the packaging sheet, and when a pressing force is applied to the pressing member, the pressing member may move together with the cutting member so that the packaging sheet is cut by the cutting member.

In addition, the driving part may further include an elastic member installed in the first supporting groove and elastically supporting the pressing member, and the elastic member may apply elastic force reversely to the pressing member when the pressing member moves by the pressing force.

In addition, the pressing member may include a pressing body disposed in the first supporting groove and a fastening part extending from the pressing body to pass through a first moving hole formed in the first supporting groove. The cutting member may be fastened to an end of the fastening part.

In addition, the pressing member may further include an engaging bar extending parallel to the fastening part from the pressing member to slidably move in a supporting hole formed in the first supporting groove, and having a engaging end, hooked by an outer edge of the supporting hole to prevent the pressing body from being separated out from the first supporting groove.

In addition, the vacuum packaging unit may further include a second supporting groove having a second moving hole formed on an extension of the first moving hole as a passage through which the cutting member moves, and a guide block having a guide hole configured to guide and support the cutting member when the cutting member is inserted and moves may be installed in the second supporting groove.

Meanwhile, according to another aspect of the present disclosure, the vacuum packaging unit may include a housing connected to a vacuum pump of the vacuum packaging unit, the driving part may include a moving member with the cutting member mounted therein and installed to reciprocate to the packaging sheet in the housing, and the moving member may move together with the cutting member by a change in air pressure in the housing caused by air suction or air discharge by the vacuum pump of the vacuum packaging unit so that the packaging sheet is cut by the cutting member.

Here, the driving part may further include an elastic member installed in the housing to elastically support the moving member and applying elastic force reversely to the moving member when the moving member moves by the change in air pressure in the housing.

In addition, the moving member may include a moving body disposed in the housing and a fastening part extending from the moving body to pass through a moving hole formed in the housing.

Here, the moving body may include an O-ring mounted therearound to tightly contact an inner surface of the housing.

In addition, a guide plate having a guide slit configured to guide and support the cutting member when the cutting member is inserted and moves may be installed on the housing.

Further, a guide groove configured to guide and support the cutting member when the cutting member is inserted and moves may be formed in a vertical direction on the housing.

Advantageous Effects

A vacuum packaging device according to example embodiments of the present invention includes a vacuum packaging unit having a cutting unit capable of forming a tearing notch on a side portion of a packaging sheet in order to easily tear the packaging sheet, thereby simply and easily opening the sealed packaging sheet.

DESCRIPTION OF DRAWINGS

FIG. 1 is a perspective view illustrating a packaging sheet having a tearing notch;

FIG. 2 is a perspective view illustrating a tearing notch formed while vacuum-packaging a packaging sheet using a vacuum packaging device according to an example embodiment of the present invention;

FIG. 3 is a perspective view illustrating the vacuum packaging device of FIG. 2;

FIG. 4 is an exploded perspective view illustrating the vacuum packaging device of FIG. 2;

FIG. 5 is an enlarged view illustrating 'A' of FIG. 4;

FIG. 6 is a vertical sectional view illustrating the vacuum packaging device of FIG. 2;

FIG. 7 is a perspective view illustrating a vacuum packaging device according to another example embodiment of the present invention;

FIG. 8 is an exploded perspective view illustrating the vacuum packaging device of FIG. 7;

FIG. 9 is an exploded perspective view illustrating a driving part disassembled in the vacuum packaging device of FIG. 8;

FIG. 10 is an enlarged view illustrating 'B' of FIG. 9; and

FIG. 11 is a vertical sectional view illustrating the vacuum packaging device of FIG. 7.

MODES FOR CARRYING OUT THE INVENTION

Hereinafter, example embodiments of the present invention will be described in more detail with reference to the accompanying drawings. It should be noted that the same or similar components in example embodiments of the present invention are designated by the same reference numerals or by these numerals with suffixes, even though they are depicted in different drawings. Additionally, well-known elements or functions of the example embodiments of the present invention will be omitted so as not to obscure the relevant details of the present invention.

FIG. 1 is a perspective view illustrating a packaging sheet having a tearing notch, and FIG. 2 is a perspective view illustrating a tearing notch formed while vacuum-packaging a packaging sheet using a vacuum packaging device according to an example embodiment of the present invention.

In addition, FIG. 3 is a perspective view illustrating the vacuum packaging device of FIG. 2, and FIG. 4 is an exploded perspective view illustrating the vacuum packaging device of FIG. 2.

In addition, FIG. 5 is an enlarged view illustrating 'A' of FIG. 4, and FIG. 6 is a vertical sectional view illustrating the vacuum packaging device of FIG. 2.

Referring to FIGS. 1 to 6, a vacuum packaging device according to an example embodiment of the present invention may include a vacuum packaging unit 100 vacuum-packaging a packaging sheet 1, and a cutting unit 200 provided to the vacuum packaging unit 100 to form a tearing notch 1*a* in the packaging sheet 1.

Here, the vacuum packaging unit 100, as disclosed in Korean Patent Application No. 10-2013-0124623, is configured to vacuumize an inside of the packaging sheet 1 by evacuating air from the packaging sheet 1 using a built-in vacuum pump and seal the packaging sheet 1 by thermally bonding an inlet of the packaging sheet 1.

Further, it is obvious that the vacuum packaging unit 100 is not limited thereto and any unit known in the art can be utilized as long as it is configured to vacuumize and seal the packaging sheet 1.

In addition, the cutting unit 200 may be configured to form the tearing notch 1*a* by cutting the packaging sheet 1.

Here, the tearing notch 1*a* may be formed in a predetermined position adjacent to content in the packaging sheet 1 rather than at a thermally bonded portion of the packaging sheet 1 so as to open the thermally bonded and sealed packaging sheet 1 afterward. For example, in the drawings, the tearing notch 1*a* may be formed to be short on a side portion of the packaging sheet 1 so as to be easily torn.

It is obvious that the tearing notch 1*a* is formed near an edge of the packaging sheet 1 to be spaced apart from an evacuated portion of the packaging sheet 1, thereby preventing external air from flowing into the packaging sheet 1 through the tearing notch 1*a*.

More specifically, the cutting unit 200 may include a cutting member 210 cutting the packaging sheet 1 and thereby forming the tearing notch 1*a*, and a driving part moving the cutting member 210 to cut the packaging sheet 1.

Here, the driving part to which the cutting member 210 is connected may be installed in the vacuum packaging unit 100 and configured to move the cutting member 210 to cut the packaging sheet 1. In some example embodiment, the driving part may be manually operated. In other example embodiments, the driving part may be automatically operated in a vacuum-packaging process of the vacuum packaging unit 100.

First, a driving part, manually operated according to an example embodiment of the present invention, will be described.

An externally exposed first supporting groove 110*a* may be formed in the vacuum packaging unit 100. The driving part may include a pressing member 220 installed in the first supporting groove 110*a* of the vacuum packaging unit 100, and an elastic member 230 elastically supporting the pressing member 220.

Here, the pressing member 220 including the cutting member 210 may be installed in the first supporting groove 110*a* to reciprocate to the packaging sheet 1.

When a pressing force is applied, the pressing member 220 may move together with the cutting member 210 so that the packaging sheet 1 is cut by the cutting member 210.

In addition, the elastic member 230 may be installed in the first supporting groove 110*a* to elastically support the pressing member 220 and reversely apply elastic force to the pressing member 220 while the pressing member 220 moves by the pressing force.

For example, the first supporting groove 110*a* may be formed in a cover 110, an upper part of the vacuum packaging unit 100 and arranged above the packaging sheet 1 inserted and seated to be vacuum-packaged in the vacuum packaging unit 100, as illustrated in the drawings. In this case, when the pressing force is applied to the pressing member 220 to move the pressing member 220 toward the packaging sheet 1 disposed thereunder, the cutting member 210 installed in a lower portion of the pressing member 220 may also move downwardly to cut a side portion of the packaging sheet 1, thereby forming the tearing notch 1*a*. For reference, a cutting edge 210*a* of the cutting member 210 may be formed in a bottom of the cutting member 210.

In addition, the elastic member 230 may be arranged to elastically support the pressing member 220 upward in the first supporting groove 110*a* as illustrated in the drawings. In this case, when the pressing member 220 moves downwardly toward the packaging sheet 1, the elastic member 230 may apply an upward elastic force to the pressing member 220. Thereafter, when the pressing force applied to the pressing member 220 is removed, the elastic member 230 may serve the pressing member 220 to return upwardly by the upward elastic force.

In other example embodiments, although not illustrated in the drawings, the first supporting groove 110*a* may be formed to be recessed upwardly from a lower part of the vacuum packaging unit 100 and arranged under the packaging sheet 1 inserted and seated to be vacuum-packaged in the vacuum packaging unit 100. In this case, when the pressing force is applied to the pressing member 220 to move the pressing member 220 toward the packaging sheet 1 disposed thereabove, the cutting member 210 may also move upwardly to cut the packaging sheet 1. Here, the cutting member 210 may be installed on the pressing member 220, and the cutting edge 210*a* may also be formed in a top of the cutting member 210. In addition, the elastic member 230 may be also disposed on the pressing member 220. In this case, when the pressing member 220 moves upwardly toward the packaging sheet 1, the elastic member 230 may apply downward elastic force to the pressing member 220. When the pressing force applied to the pressing member 220 is removed, the elastic member 230 may serve the pressing member 220 to return downwardly by the downward elastic force.

In addition, although not illustrated in the drawings, although not illustrated in the drawings, it is obvious that the pressing member 220 may be installed to be manually pushed in a direction and pulled in a reverse direction without the elastic member 230. Here, a handle may be formed on the pressing member 220 so that the pressing member 220 is easily gripped when the pressing member 220 is pulled in the reverse direction.

Meanwhile, the pressing member 220 will be specifically described with reference to the drawings. The pressing member 220 may include a pressing body 221 disposed in the first supporting groove 110*a* and a fastening part 222 extending from the pressing body 221.

The fastening part 222 may extend from the pressing body 221 and pass through a first moving hole 110*b* 111*a* formed in the first supporting groove 110*a*, and the cutting member 210 may be fastened and fixed to an end portion of the fastening part 222.

In addition, the pressing member 220 may further include a engaging bar 223 configured to prevent the pressing body 221 from being separated out from the first supporting groove 110*a*.

Here, the engaging bar 223 may extend parallel to the fastening part 222 from the pressing body 221 and pass through a supporting hole 110*c* formed in the first supporting groove 110*a*. In addition, the engaging bar 223 may include an engaging end 223*a* hooked on an outer edge of the supporting hole 110*c*.

The engaging bar 223 may not only prevent the pressing body 221 from being separated from the first supporting groove 110*a* but also function as a guide stably guiding the movement of the pressing body 221 since it is formed at both side portions of the pressing body 221 to slidably move in the supporting hole 110*c* of the first supporting groove 110*a*.

Further, the vacuum packaging unit 100 may include a second supporting groove 120*a* having a second moving hole 120*b* and formed as a passage through which the cutting member 210 moves on an extension of the moving hole 110*b* 111*a*, and a guide block 121 may be installed in the second supporting groove 120*a*. Meanwhile, the second supporting groove 120*a* may be formed in a body 120 of the vacuum packaging unit 100.

The guide block 121 may include a guide hole 121*a*, which serves to guide and support the cutting member 210 while the cutting member 210 is inserted and moves. That is, the guide hole 121*a* of the guide block 121 may guide and support the cutting member 210 to prevent rotating or shaking of the cutting member 210 while the cutting member 210 moves.

Meanwhile, a driving part, which automatically operates, according to another example embodiment of the present invention will be described with reference to FIG. 1 and FIGS. 7 to 11.

FIG. 7 is a perspective view illustrating a vacuum packaging device according to another example embodiment of the present invention, and FIG. 8 is an exploded perspective view illustrating the vacuum packaging device of FIG. 7.

In addition, FIG. 9 is an exploded perspective view illustrating a driving part disassembled in the vacuum packaging device of FIG. 8, FIG. 10 is an enlarged view illustrating 'B' of FIG. 9, and FIG. 11 is a vertical sectional view illustrating the vacuum packaging device of FIG. 7.

Referring to FIG. 1 and FIGS. 7 to 11, a housing H connected to a vacuum pump (not illustrated) of the vacuum packaging unit 100 may be formed in the vacuum packaging unit 100, and the driving part may include a moving member 260 installed in the housing H and an elastic member 270 elastically supporting the moving member 260.

Here, the housing H may include a support receiving member 122 having a receiving groove 122 in which the moving member 260 is accommodated, and a cover 110 installed in a body 120 of the vacuum packaging unit 100 and covering the support receiving member 122. Here, a clamping member clamping the packaging sheet 1 may be utilized in the cover 110, as illustrated in FIG. 11.

Here, the moving member 260 may include a cutting member 210, and may be installed in the housing H to reciprocate to the packaging sheet 1. Here, the reciprocating movement to the packaging sheet 1 may mean that the moving member 260 moves such that a distance to the packaging sheet 1 changes, and may include a concept of reciprocating movement in a direction opposite to the packaging sheet 1.

The moving member 260 may move by a change in an air pressure in the housing H caused by air suction or air discharge by the vacuum pump (not illustrated) of the vacuum packaging unit 100. In this regard, a connecting tube 122*b* connected to the vacuum pump (not illustrated) may be formed in the housing H.

In addition, the elastic member 270 may be installed in the housing H to elastically support the moving member 260. Accordingly, the elastic member 270 may reversely apply elastic force to the moving member 260 while the moving member 260 moves by the change in an air pressure in the housing H.

Meanwhile, when the moving member 260 is operated by the air suction by the vacuum pump, the connecting tube 122*b* of the housing H may be connected to an air suction part (not illustrated) of the vacuum pump, as illustrated in the drawings.

Accordingly, when the vacuum pump operates, the moving member 260 may move in a downward direction opposite to the packaging sheet 1 since a negative pressure is generated in a space below the moving member 260 in the housing H. At the same time, the cutting member 210 installed in the moving member 260 may move together with the moving member 260 to cut a side portion of the packaging sheet 1, thereby forming a tearing notch 1*a*. Here, an end of the cutting member 210 is bent, and a cutting edge 210*a* may be formed in the bent portion. The cutting edge 210*a* may be disposed above the packaging sheet 1.

In addition, the elastic member 270 may be disposed to elastically support the moving member 260 in an upward direction in the housing H. In this case, the elastic member 270 may apply an upward elastic force to the moving member 260 when the moving member 260 moves in the downward direction opposite to the packaging sheet 1. Thereafter, when the negative pressure is removed from the space below the moving member 260 in housing H, the elastic member 270 may serve the moving member 260 to return upwardly by the upward elastic force. Here, it is obvious that an additional air-inflow route through which air flows into the housing H after the operation of the vacuum pump is stopped may be properly set to remove the negative pressure from the housing H.

Further, in other example embodiments of the present invention, although not illustrated in the drawings, the connecting tube 122*b* of the housing H may have a structure connected to an air discharger (not illustrated) of the vacuum pump when the moving member 260 is operated by air discharge of the vacuum pump. Accordingly, when the vacuum pump operates, the moving member 260 may move upwardly to the packaging sheet 1 since a positive force is generated in the space below the moving member 260 in housing H. At this time, the cutting member 210 installed in the moving member 260 may also move to cut a side portion of the packaging sheet 1, thereby forming a tearing notch 1*a*. Here, the cutting member 210 may be formed as a straight line without being bent at the end thereof. The cutting edge 210*a* may be formed at an upper end of the cutting member 210 and disposed under the packaging sheet 1. In addition, the elastic member 270 may be disposed to elastically support the moving member 260 in a downward direction in the housing H. In this case, when the moving member 260 moves upwardly to the packaging sheet 1, the elastic member 270 may apply downward elastic force to the moving member 260. Thereafter, when a positive force is removed from the space below the moving member 260 in the housing H, the elastic member 270 may serve the moving member 260 to return downwardly by the downward elastic force. Here, it is obvious that an additional air-inflow route through which air flows into the housing H after the operation of the vacuum pump is stopped may be properly set to remove the positive pressure from the housing H.

Meanwhile, the moving member 260 will be described in more detail with reference to the drawings. The moving member 260 may include a moving body 261 disposed in the housing H and a fastening part 262 extending from the moving body 261.

The fastening part 262 may extend from the moving body 261 to pass through a through hole 123*a* formed in the housing H. The cutting member 210 may be fastened and fixed to an end of the fastening part 262. Here, the through hole 123*a* may be formed in the cover 110 in the housing H.

In addition, the moving body 261 may include an O-ring 263 mounted therearound to tightly contact an inner surface of the housing H. Accordingly, generation of a gap between the space below the moving member 260 and a space above the moving member 260 in the housing H may be prevented, and the positive pressure or the negative pressure generated in the space below the moving member 260 may be maintained.

In addition, a guide plate 124 may be installed on the housing H. The guide plate 124 may include a guide slit 124*a* configured to guide and support the cutting member 210 when the cutting member is inserted and moves.

In addition, a guide groove 125 configured to guide and support the cutting member 210 when the cutting member 210 is inserted and moves may be formed in a vertical direction on the housing H.

The guide slit 124*a* and the guide groove 125 may serve to guide the cutting member 210 so that the cutting member 210 does not rotate or shake when it moves.

As set forth above, since the vacuum packaging device according to the example embodiments of the present invention includes the vacuum packaging unit 100 having the cutting unit 200 configured to form the tearing notch 1*a* on the side portion of the packaging sheet 1, the sealed packaging sheet 1 may be simply and easily opened.

While exemplary embodiments have been shown and described above, it will be apparent to those skilled in the art that modifications and variations could be made without departing from the scope of the invention as defined by the appended claims.

The invention claimed is:

1. A vacuum packaging device, comprising:

a vacuum packaging unit configured to vacuum-package a packaging sheet; and a cutting unit formed in the vacuum packaging unit to form a tearing notch on the packaging sheet, wherein the tearing notch is positioned on a side portion of the packaging sheet and formed at a position adjacent to contents in the packaging sheet rather than at a thermally bonded portion of the packaging sheet to open the thermally bonded and sealed packaging sheet afterward, wherein the cutting unit comprises:

a cutting member configured to cut the packaging sheet to form the tearing notch; and a driving part installed in the vacuum packaging unit to be connected to the cutting member and move the cutting member to cut the packaging sheet, wherein the vacuum packaging unit includes a housing connected to a vacuum pump of the vacuum packaging unit, the driving part includes a moving member with the cutting member mounted therein and installed to reciprocate to the packaging sheet in the housing, the housing includes a connecting tube formed in a lower portion thereof, and the connecting tube is connected to an air suction part of the vacuum pump, and the vacuum pump is configured to suction the air from the housing to form a negative pressure in the lower portion of the housing such that the moving member in which the cutting member is mounted moves in a downward direction to cut the side portion of the packaging sheet and form the tearing notch.

2. The vacuum packaging device of claim 1, wherein the driving part further includes an elastic member installed in the housing to elastically support the moving member and apply an elastic force reversely to the moving member when the moving member moves by the change in air pressure in the housing.

3. The vacuum packaging device of claim 1, wherein the moving member comprises:

a moving body disposed in the housing; and a fastening part extending from the moving body to pass through a moving hole formed in the housing.

4. The vacuum packaging device of claim 3, wherein the moving body includes an O-ring mounted therearound to tightly contact an inner surface of the housing.

5. The vacuum packaging device of claim 1, wherein a guide plate having a guide slit configured to guide and support the cutting member when the cutting member is inserted and moves, is installed on the housing.

6. The vacuum packaging device of claim 1, wherein a guide groove configured to guide and support the cutting member when the cutting member is inserted and moves, is formed in a vertical direction on the housing.

* * * * *